US008915457B2

(12) United States Patent
Dodd et al.

(10) Patent No.: US 8,915,457 B2
(45) Date of Patent: Dec. 23, 2014

(54) CELLULOSE FIBRILLATION

(71) Applicant: Weyerhaeuser NR Company, Federal Way, WA (US)

(72) Inventors: Andrew J. Dodd, Seattle, WA (US); Andre S. Hajnal, Anderson Island, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 281 days.

(21) Appl. No.: 13/627,625

(22) Filed: Sep. 26, 2012

(65) Prior Publication Data

US 2013/0082128 A1 Apr. 4, 2013

Related U.S. Application Data

(60) Provisional application No. 61/541,831, filed on Sep. 30, 2011.

(51) Int. Cl.
*D21C 3/00* (2006.01)
*B02C 7/00* (2006.01)

(52) U.S. Cl.
CPC ..... *B02C 7/00* (2013.01)
USPC ..... 241/24.19; 241/24.29; 241/30

(58) Field of Classification Search
CPC ..... B02C 23/16; D21D 1/02
USPC ..... 241/24.19, 24.29, 30; 162/23, 26–28
See application file for complete search history.

(56) References Cited

U.S. PATENT DOCUMENTS

| | | | | |
|---|---|---|---|---|
| 3,301,745 | A * | 1/1967 | Coppick et al. | 162/55 |
| 3,415,456 | A * | 12/1968 | Bidwell | 241/21 |
| 3,873,034 | A * | 3/1975 | Iwahori et al. | 241/55 |
| 4,374,702 | A * | 2/1983 | Turbak et al. | 162/100 |
| 4,562,969 | A * | 1/1986 | Lindahl | 241/21 |
| 5,123,962 | A | 6/1992 | Komuro et al. | |
| 6,837,452 | B2 * | 1/2005 | Dezutter et al. | 241/16 |
| 6,905,798 | B2 | 6/2005 | Tsukuda et al. | |
| 7,381,294 | B2 | 6/2008 | Suzuki et al. | |
| 7,566,014 | B2 | 7/2009 | Koslow et al. | |
| 2005/0194477 | A1 * | 9/2005 | Suzuki | 241/20 |
| 2008/0057307 | A1 | 3/2008 | Koslow et al. | |
| 2010/0288456 | A1 * | 11/2010 | Westland et al. | 162/57 |
| 2011/0105650 | A1 * | 5/2011 | Yan | 524/35 |

* cited by examiner

*Primary Examiner* — Faye Francis
*Assistant Examiner* — Onekki Jolly
(74) *Attorney, Agent, or Firm* — Timothy M. Whalen; Weyerhaeuser Law Dept

(57) ABSTRACT

A process for making a fibrillated blend of lyocell and cellulose pulp fibers in which a blend of lyocell and cellulose pulp fibers is provided. The lyocell is from 25% to 75% of the total weight of the blend of lyocell and cellulose pulp fibers. The blend is refined in a high shear field device to provide a blend of fibrillated lyocell and pulp fibers having a diameter of 10 to 500 nanometers and a fiber length of 50 to 500 μm. The high shear field device can be a homogenizer or colloid mill.

10 Claims, 4 Drawing Sheets

CELLULOSE FIBRILLATION

The field of the invention is the fibrillation of cellulose fibers. Specifically, the field of the invention is the fibrillation of cellulose wood pulp fibers and regenerated cellulose wood pulp fibers.

Heretofore it has required a two step fibrillation system in order to provide cellulose wood pulp fibers or regenerated cellulose wood pulp fibers or combinations of wood pulp fibers and regenerated cellulose wood pulp fibers having a fiber diameter of 10 to 500 nanometers and a length of 50 to 800 μm. Such fibers would provide an appropriate stress/strain curve when compounded with rubber.

In the two step system, the fibers would be partially fibrillated in a first step and finally fibrillated in a second step. In a typical system the fibers would be treated first in a hydropulper and secondly in a homogenizer.

DETAILED DESCRIPTION

Figure 1:
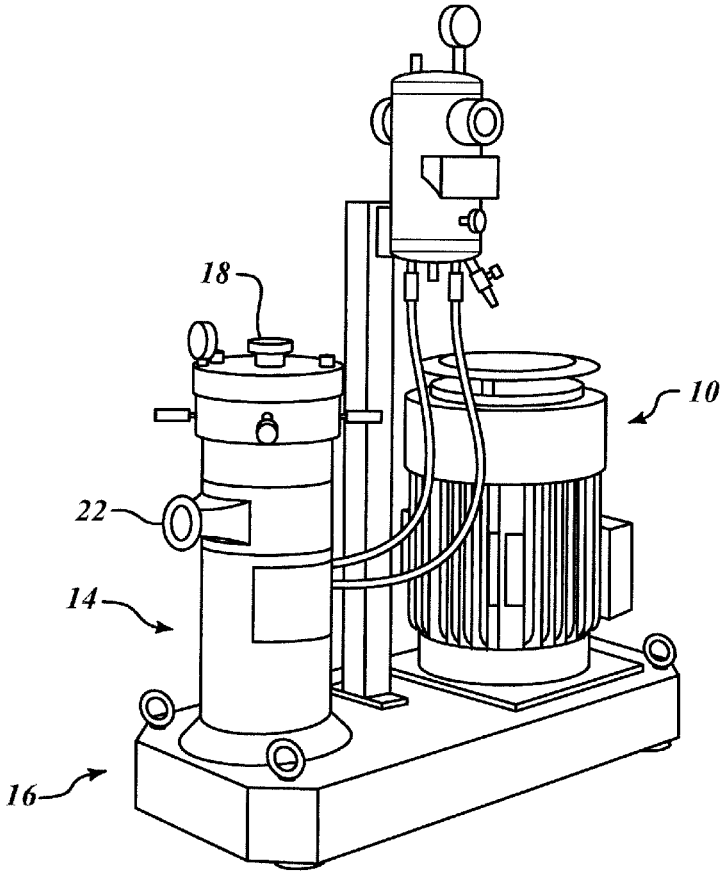
FIG. 1 is a diagram of a refiner.

The typical method of fibrillating lyocell or a lyocell/wood pulp fiber combination is in a two step process. The two steps fibrillation may use a hydropulper or similar device followed by a device such as a homogenizer. The earlier application Ser. No. 12/466,277 Fibrillated blend of lyocell low DP pulp, filed May 14, 2008 and published as patent publication 2010/00288456 disclosed a one step system but it was later discovered that this was the first step of a two step process because the fiber from the disclosed hydropulper or British disintegrator process had to then be passed through a homogenizer.

The use of a single step fibrillation process in place of a two step fibrillation process results in lower cost. The lower cost is both in equipment cost and processing cost. There is less equipment to maintain and adjust.

The problem has been to discover a one step fibrillation process and equipment which would provide a fibrillated product having properties which would be comparable to the properties of a fibrillated product from a two step process.

The inventor has discovered a process and equipment for a one step fibrillation system for lyocell, or a lyocell/cellulose wood pulp combination The description of the one step process starts with a description of the materials being provided to the process.

Lyocell

Regenerated cellulose fibers may be prepared using various amine oxides or ionic liquids as solvents. In particular, N-methylmorpholine-N-oxide (NMMO) with about 12% water present is a particularly useful solvent. The cellulose is dissolved in the solvent under heated conditions, usually in the range of 90° C. to 130° C., and extruded from a multiplicity of fine apertured spinnerets into air. The filaments of cellulose dope are continuously mechanically drawn in air by a factor in the range of about three to ten times to cause molecular orientation. They are then led into a nonsolvent, usually water, or water/NMMO mixture to regenerate the cellulose. Other regeneration solvents, such as lower aliphatic alcohols, have also been suggested.

Other solvents that can be mixed with NMMO, or another tertiary amine solvent, include dimethylsulfoxide (DMSO), dimethylacetamide (DMAC), dimethylformamide (DMF) and caprolactan derivatives. Ionic liquids or mixtures of ionic liquids and aprotic or protic liquids are also suitable. Examples of the cation moiety of ionic liquids are cations from the group consisting of cyclic and acyclic cations. Cyclic cations include pyridinium, imidazolium, and imidazole and acyclic cations include alkyl quaternary ammonium and alkyl quaternary phosphorous cations. Counter anions of the cation moiety are selected from the group consisting of halogen, pseudohalogen and carboxylate. Carboxylates include acetate, citrate, malate, maleate, formate, and oxylate and halogens include chloride, bromide, zinc chloride/choline chloride, 3-methyl-N-butyl-pyridinium chloride and benzyldimethyl (tetradecyl) ammonium chloride. Substituent groups, (i.e. R groups), on the cations can be $C_1$, $C_2$, $C_3$, and $C_4$; these can be saturated or unsaturated. Examples of compounds which are ionic liquids include, but are not limited to, 1-ethyl-3-methyl imidazolium chloride, 1-ethyl-3-methyl imidazolium acetate, 1-butyl-3-methyl imidazolium chloride, 1-allyl-3-methyl imidazolium chloride. Pulps used for lyocell will usually fully dissolve in NMMO or ionic liquid in 10 to 90 minutes. Shorter times are preferred. The term "fully dissolve", when used in this context, means that substantially no undissolved particles are seen when a dope, formed by dissolving compositions of the present invention in NMMO or ionic liquids, is viewed under a light microscope at a magnification of 40× to 70×.

Cellulose textile fibers spun from NMMO or ionic liquid solution are referred to as lyocell fibers. Lyocell is an accepted generic term for a fiber composed of cellulose precipitated from an organic solution in which no substitution of hydroxyl groups takes place and no chemical intermediates are formed. One lyocell product produced by Lenzing AG is presently commercially available as Tencel® fiber. These fibers are available in 0.9-5.7 denier weights and heavier. Denier is the weight in grams of 9000 meters of a fiber. Because of their fineness, yarns made from them produce fabrics having extremely pleasing hands. The term "lyocell" in this application includes polynosic fiber.

Two widely recognized problems of lyocell fabrics are caused by fibrillation of the fibers under conditions of wet abrasion, such as might result during laundering. Fibrillation tends to cause "pilling"; i.e., entanglement of fibrils into small relatively dense balls. It is also responsible for a "frosted" appearance in dyed fabrics. Fibrillation is believed to be caused by the high orientation and apparent poor lateral cohesion within the fibers. There is an extensive technical and patent literature discussing the problem and proposed solutions.

The lyocell can be made from a bleached or unbleached pulp or a mixture of pulp and lignin. The pulp may be a traditional dissolving pulp or a kraft pulp containing hemicellulose and having a DP of 200 to 1100, and a hemicellulose content of 3 to 20% and has been specially treated to be compatible with lyocell solvents such as the amine oxides and ionic liquid and other solvents noted above.

Pulps used for lyocell, including the specially treated kraft pulp, have a number of attributes that allow then to be compatible with the lyocell solvents, such as amine oxide and ionic liquid and other solvents noted above. The lyocell pulps have a copper number of less than about 2.0, and can have a copper number less than about 0.7, as measured by Tappi T430 cm-99. The lyocell pulps have a carbonyl content of less than about 120 μmol/g and a carboxyl content of less than about 120 μmol/g. The carboxyl and carbonyl group content are measured by TAPPI TM 237 or by means of proprietary assays performed by Thuringisches Institut fur Textil-und Kunstoff Forschunge. V., Breitscheidstr. 97, D-07407 Rudolstadt, Germany.

The lyocell pulps possess a low transition metal content. Preferably, the total transition metal content is less than 20 ppm, more preferably less than 5 ppm, as measured by Tappi 266 om-94. The term "total transition metal content" refers to the combined amounts, measured in units of parts per million (ppm), of nickel, chromium, manganese, iron and copper. The lyocell pulps have an iron content that is less than 4 ppm, more preferably less than 2 ppm, as measured by Tappi 266 om-94, and the copper content of pulp used for lyocell is preferably less than 1.0 ppm, more preferably less than 0.5 ppm, as measured by Tappi 266 om-94.

Additionally, lyocell fibers may have a natural crimp of irregular amplitude and period that confers a natural appearance on the fibers. The crimp amplitude may be greater than about one fiber diameter and the crimp period is greater than about five fiber diameters.

Processes For Forming Fibers

As described above, one process for forming lyocell fibers is the dry jet/wet process. In this process the filaments exiting the spinneret orifices are mechanically drawn through an air gap and then submerged and coagulated and stretched mechanically in a liquid bath before drying. Dried lyocell fiber can be cut to different length from 2 to 12 mm Never dried lyocell can be cut to 2 to 12 mm too and used directly for fibrillation.

Another process is generally termed "melt blowing". The fibers are extruded through a series of small diameter orifices into an air stream flowing generally parallel to the extruded fibers. This draws or stretches the fibers. The stretching serves two purposes. It causes some degree of longitudinal molecular orientation and reduces the ultimate fiber diameter. Meltblowing typically produces fibers having a small diameter (most usually less than 10 μm) which are useful for producing non-woven materials.

In one embodiment of the melt-blowing method, the dope is transferred at somewhat elevated temperature to the spinning apparatus by a pump or extruder at temperatures from 70° C. to 140° C. Ultimately the dope is directed to an extrusion head having a multiplicity of spinning orifices. The dope filaments emerge into a relatively high velocity turbulent gas stream flowing in a generally parallel direction to the path of the latent fibers. As the dope is extruded through the orifices the liquid strands or latent filaments are drawn (or significantly decreased in diameter and increased in length) during their continued trajectory after leaving the orifices. The turbulence induces a natural crimp and some variability in ultimate fiber diameter both between fibers and along the length of individual fibers. The crimp is irregular and will have a peak to peak amplitude that is usually greater than about one fiber diameter with a period usually greater than about five fiber diameters. At some point in their trajectory the fibers are contacted with a regenerating solution. Regenerating solutions are nonsolvents such as water, lower aliphatic alcohols, or mixtures of these. The NMMO used as the solvent can then be recovered from the regenerating bath for reuse. Preferably the regenerating solution is applied as a fine spray at some predetermined distance below the extrusion head.

A somewhat similar process is called "spunbonding" where the fiber is extruded into a tube and stretched by an air flow through the tube caused by a vacuum at the distal end. In general, spunbonded fibers are continuous while melt blown fibers are more usually in discrete shorter lengths.

Another process, termed "centrifugal spinning", differs in that the fiber is expelled from apertures in the sidewalls of a rapidly spinning drum. The fibers are drawn somewhat by air resistance as the drum rotates. However, there is not usually a strong air stream present as in meltblowing.

Dissolving Grade Pulp

Most currently available lyocell fibers are produced from high quality wood pulps that have been extensively processed to remove non-cellulose components, especially hemicellulose. These highly processed pulps are referred to as dissolving grade or high alpha (or high α) pulps, where the term alpha (or α) refers to the percentage of cellulose (Tappi, T 203 CM-99). Thus, a high alpha pulp contains a high percentage of cellulose, and a correspondingly low percentage of other components, especially hemicellulose. The processing required to generate a high alpha pulp and the fact that pulp yield is less because a high alpha pulp contains less of the starting raw material significantly adds to the cost of lyocell fibers and products manufactured from lyocell fibers.

Dissolving grade pulps are traditionally produced by the sulfite process but the kraft process can be used with certain modifications.

When the kraft process is used to produce a pulp, a mixture of sodium sulfide and sodium hydroxide is used to pulp the wood. Conventional kraft processes stabilize residual hemicelluloses against further alkaline attack, so it is not possible to obtain acceptable quality dissolving pulps, i.e., high alpha pulps, through subsequent treatment of kraft pulp in the bleaching stages because the hemicellulose remains in the pup. In order to prepare dissolving type pulps by the kraft process, it is necessary to give the raw material an acidic pretreatment before the alkaline pulping stage. A significant amount of material primarily hemicellulose, on the order of 10% or greater of the original wood substance, is solubilized in this acid phase pretreatment and thus process yields drop. Under the prehydrolysis conditions, the cellulose is largely resistant to attack, but the residual hemicelluloses are degraded to a much shorter chain length and can therefore be removed to a large extent in the subsequent kraft cook by a variety of hemicellulose hydrolysis reactions or by dissolution.

The prehydrolysis stage normally involves treatment of wood at elevated temperature (150-180° C.) with dilute mineral acid (sulfuric or aqueous sulfur dioxide) or with water alone requiring times up to 2 hours at the lower temperatures. In the latter case, liberated acetic acid from certain of the naturally occurring polysaccharides (predominantly the mannans in softwoods and the xylan in hardwoods) lowers the pH below 4.

A non-dissolving kraft pulp may also be used for lyocell. It has its degree of polymerization adjusted to 200 to 1100 and its copper number and transition metals adjusted to be compatible with the lyocell solvents. It will be described hereafter.

Degree of Polymerization

The term "degree of polymerization" (abbreviated as DP) refers to the number of D-glucose monomers in a cellulose molecule. Thus, the term "average degree of polymerization", or "average D.P.", refers to the average number of D-glucose molecules per cellulose polymer in a population of cellulose polymers.

The DP of a pulp will depend on the species of wood being used. Hardwoods and softwoods will have different DPs. The DP of a pulp will also depend on the pulping system and bleaching system being used. A kraft paper pulp which retains hemicellulose will have a higher DP than a kraft or some sulfite dissolving pulps which has far less and usually no hemicellulose. Some dissolving pulps can have a high DP.

The DP of a pulp will also depend of the method of measuring it. The measurements of DP in this application are by ASTM Test 1795-96 which uses a Cuene (cupriethylenediamine) solvent. Other tests use a Cuam (cuprammonium hydroxide) solvent or a LiCl/DMAc (lithium chloride/dimethylacetamide) solvent. Klemme et al *Comprehensive Organic Chemistry, Vol.* 1, *Fundamentals and analytical methods, Wiley-VCH* 1998 report the following D.P. for pulps using Cuam: Papergrade softwood pulp: greater than 1000, dissolving grade softwood pulp: 300-1700, paper grade hardwood pulp: greater than 1000, dissolving grade hardwood pulp: 300-1000.

Sixta *Handbook of pulp, Vol.* 2, Wiley-VCH 2006 lists pine kraft pulp with ECF bleaching to have a $DP_v$ of 2207 measured with a Cuene solvent and $DP_w$ 2827 and a. $DP_n$ of 659 measured with LiCl/DMAc/cellulose solution using GPC procedure.

Sixta also shows the DP for different species, pulping systems and bleaching systems. Sixta provide the following DP: kraft pine with ECF (elemental chlorine free) bleaching has a Cuene DP of 2207 and a Cuam DP of 2827, kraft spruce with TCF (total chlorine free) bleaching has a Cuene 1648 and a Cuam DP of 2251, eucalyptus kraft with ECF bleaching has a Cuene DP of 2355 and a Cuam DP of 2847, beech sulfite pulp with ECF bleaching has a Cuene DP of 2240 and a Cuam DP of 2636, spruce sulfite pulp with TCF bleaching has a Cuene DP of 3074 and a Cuam DP of 3648, spruce sulfite pulp with ECF bleaching has a Cuene DP of 2486 and a Cuam DP of 3144, and beech sulfite pulping with TCF bleaching has a Cuene DP of 3489 and a Cuam DP of 4050. It is noted that the Cuam method has higher DPs than the Cuene method.

The DP distribution can be unimodal, i.e., the modal DP value being the DP value that occurs most frequently within the distribution, or multimodal, i.e., a distribution of cellulose DP values that has several relative maxima. A multimodal, treated pulp might be formed, for example, by mixing two or more unimodal, treated pulps, each having a different modal DP value. The distribution of cellulose DP values can be determined by GPC method (Sixta *Handbook of pulp, Vol.* 2, Wiley-VCH 2006).

Lowering the Degree of Polymerization

There are methods for reducing the DP of a non-prehydrolyzed kraft pulp to a DP in the range of 200 to 1000 or a DP in the range of 300 to 850, or a DP in the range of 400 to 750. It may be done without substantially reducing the hemicellulose content. The pulp can be a bleached, semi-bleached or unbleached kraft softwood pulp. Low DP saw dust pulp, lyocell pulp or viscose grade pulp can be manufactured using these methods.

This DP reduction treatment occurs after the pulping process and before, during or after the bleaching process, if a bleaching step is utilized. This includes a portion of the DP reduction step occurring at the same time as a portion of the bleaching step. Preferably the bleaching step, if utilized, occurs before treatment to reduce the average DP of the cellulose.

The methods of reducing the DP can include treating pulp with acid, or an acid substitute, or a combination of acids and acid substitutes, steam, alkaline chlorine dioxide, cellulase, the combination of at least one transition metal and a peracid, preferably peracetic acid, and the combination of ferrous sulfate and hydrogen peroxide.

The following methods are illustrative.

A means of treating the pulp in order to reduce the average DP of the cellulose without substantially reducing the hemicellulose content is to treat the pulp with acid. Any acid can be utilized, including, but not limited to: hydrochloric, phosphoric, sulfuric, acetic and nitric acids, provided only that the pH of the acidified solution can be controlled. Sulfuric acid is used because it is a strong acid that does not cause a significant corrosion problem when utilized in an industrial scale process. Additionally, acid substitutes can be utilized instead of, or in conjunction with, acids. An acid substitute is a compound which forms an acid when dissolved in the solution containing the pulp. Examples of acid substitutes include sulfur dioxide gas, nitrogen dioxide gas, carbon dioxide gas and chlorine gas.

The acid, or combination of acids, is preferably utilized in an amount of from about 0.1% w/w to about 10% w/w in its aqueous solution, and the pulp is contacted with the acid for a period of from about 2 minutes to about 5 hours at a temperature of from about 20° C. to about 180° C. The amount of acid or acid substitute will be sufficient to adjust the pH of the pulp to a value within the range of from about 0.0 to about 5.0. The amount, time, temperature and pH can be at a range within these ranges. The rate at which D.P. reduction occurs can be increased by increasing the temperature and/or pressure under which the acid treatment is conducted. Preferably the pulp is stirred during acid treatment, although stirring should not be vigorous.

When the reagent is steam, the steam is preferably utilized at a temperature of from about 120° C. to about 260° C., at a pressure from about 150 psi to about 750 psi, and the pulp is exposed to the steam for a period of from about 0.5 minutes to about 10 minutes. The steam may include at least one acid. The steam may include an amount of acid sufficient to reduce the pH of the steam to a value within the range of from about 1.0 to about 4.5. The exposure of the pulp to both acid and steam permits the use of lower pressure and temperature to reduce the average D.P. of the cellulose compared to the use of steam alone.

When the reagent is a combination of at least one transition metal and peracetic acid, the transition metal(s) is present at a concentration of from about 5 ppm to about 50 ppm, the peracetic acid is present at a concentration of from about 5 mmol per liter to about 200 mmol per liter, and the pulp is contacted with the combination for a period of from about 0.2 hours to about 3 hours at a temperature of from about 40° C. to about 100° C.

When the reagent is a combination of ferrous sulfate and hydrogen peroxide, the ferrous sulfate is present at a concentration of from about 0.1 M to about 0.6 M, the hydrogen peroxide is present at a concentration of from about 0.1% v/v to about 1.5% v/v, and the pulp is contacted with the combination for a period of from about 10 minutes to about one hour at a pH of from about 3.0 to about 5.0.

Yet other means of treating the pulp in order to reduce the average DP of the cellulose, but without substantially reducing the hemicellulose content, is to treat the pulp with alkaline chlorine dioxide or with alkaline sodium hypochlorite, oxygen, or ozone.

The hemicellulose content of the treated pulp, expressed as a weight percentage, is from about 7% by weight to about 30% by weight or a range within that range. As used herein, the term "percent (or %) by weight" or "weight percentage", when applied to the hemicellulose or lignin content of treated pulp, means weight percentage relative to the dry weight of the treated pulp.

Hemicellulose and lignin content are measured by a sugar content assay based on Tappi T249 cm-00 and lignin content in the same sample was estimated from the solid residue after filtration of sugar solution from hydrolyzed samples.

Copper Number

If a nonprehydrolyzed kraft pulp is used for lyocell then its DP needs to be reduced as discussed above and it is further treated to lower the copper number to a value of less than 2.0, more preferably less than about 1.1, most preferably less than about 0.7, as measured by Tappi T430 cm-99. A low copper number is desirable because it is generally believed that a high copper number causes cellulose degradation during and after dissolution. The copper number is an empirical test used to measure the reducing value of cellulose. The copper number is expressed in terms of the number of milligrams of metallic copper which is reduced from cupric hydroxide to cuprous oxide in alkaline medium by a specified weight of cellulosic material. The copper number of the treated pulp can be reduced, for example, by treating the pulp with sodium borohydride or sodium hydroxide or by treating the pulp with one or more bleaching agents including, but not limited to, sodium hypochlorite, chlorine dioxide, peroxides (such as hydrogen peroxide) and peracids (such as peracetic acid).

The copper number of the low DP pulp used in the blend with lyocell fiber does not need a low copper number and need not be treated to reduce the copper number. It can, however, have a reduced copper number.

Fibrillated Blend of Lyocell and Pulp

Applicants have found that a fibrillated blend of lyocell and a cellulose wood pulp provides a material that does disperse and does provide better modulus of elasticity, toughness and strength. The wood pulp can be standard hardwood or softwood kraft pulp, fluff pulp, papermaking pulp or pulp having a low degree of polymerization (DP) What physical attributes are provided and how much is provided will depend on the material with which the lyocell/pulp blend is combined.

In one embodiment the DP of the pulp can be from 1600 to 3500 (Sixta DP).

In one embodiment the DP of the low DP pulp can be from 200 to 1000 as measured by ASTM Test 1795-96 which uses a Cuene (cupriethylenediamine) solvent. In another embodiment the DP of the low DP pulp can be from 300 to 850 as measured by ASTM Test 1795-96. In another embodiment the DP of the low DP pulp can be from 400 to 750 as measured by ASTM Test 1795-96.

In one embodiment the blend can be from 25 to 75 percent by weight lyocell with the remainder low DP pulp. In one embodiment the lyocell can be 40 to 60 percent by weight lyocell with the remainder low DP pulp. In one embodiment the lyocell can be 50 percent by weight with the remainder low DP pulp.

In one embodiment the lyocell has a length of 3 to 12 mm. In one embodiment the lyocell has a length of 3 to 10 mm. In one embodiment the lyocell has a length of 4 to 8 mm. In each of these embodiments fibrils of the fibrillated lyocell usually may have a diameter or width in the range of 10 to 500 nanometers to provide an aspect ratio of greater than 100 to one thousand or more.

The non-regenerated cellulose breaks into fibrils, particles and fines, the majority of which also have high aspect ratios which are useful in dispersing the regenerated cellulose material. There is little differentiation between the regenerated and non-regenerated cellulose material after processing through the colloid mill. There may be a few fines of kraft pulp fiber or lyocell after processing.

The blend is formed by fibrillating the lyocell and pulp together.

The Two Step Process

In one embodiment the lyocell and low DP pulp may be mixed in a disintegrator or hydropulper for from 5 to 780 minutes. In another embodiment the lyocell and low DP pulp may be mixed in a disintegrator or hydropulper for from 60 to 180 minutes. The disintegrator operates at 2700 to 3300 rpm and the hydropulper at around 500 to 900 rpm. The consistency of the blend in the mixer will be from 0.5 to 5%. The consistency of the blend in the disintegrator is around 1-2% and in the hydropulper 2-4% on a weight basis. The fibrillated blend can be shipped in water slurry at a consistency of 0.5 to 100%.

The second stage of a two step process would be a pressure drop homogenizer or other high shear field device such as a high shear homogenizer.

After the second step of the high shear homogenizer the Kraft pulp and the 3 to 12 mm Lyocell have fibrillated to a similar extent with the mean diameter being 110 nm There are a few fines left from the Kraft fiber.

One Step Process

The present one step process may be used with lyocell, pulp or a mix of lyocell and either standard cellulose wood pulp fibers or low DP cellulose wood pulp fibers.

The process uses a high shear field device such as a high shear homogenizer or colloid mill. A number of other types of equipment were tried in a one step process but none provided a product that was the equivalent of the product of a two step process. These included, but were not limited to, a double disk refiner, a PFI mill and a valley beater.

Figure 2:
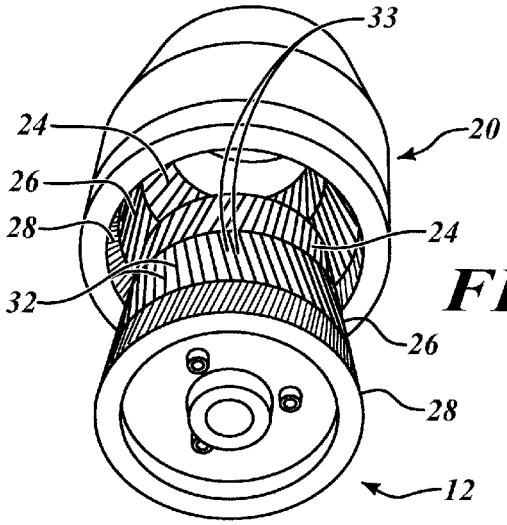
FIG. 2 is an expanded view of the rotor and stator of the refiner.
Figure 3:
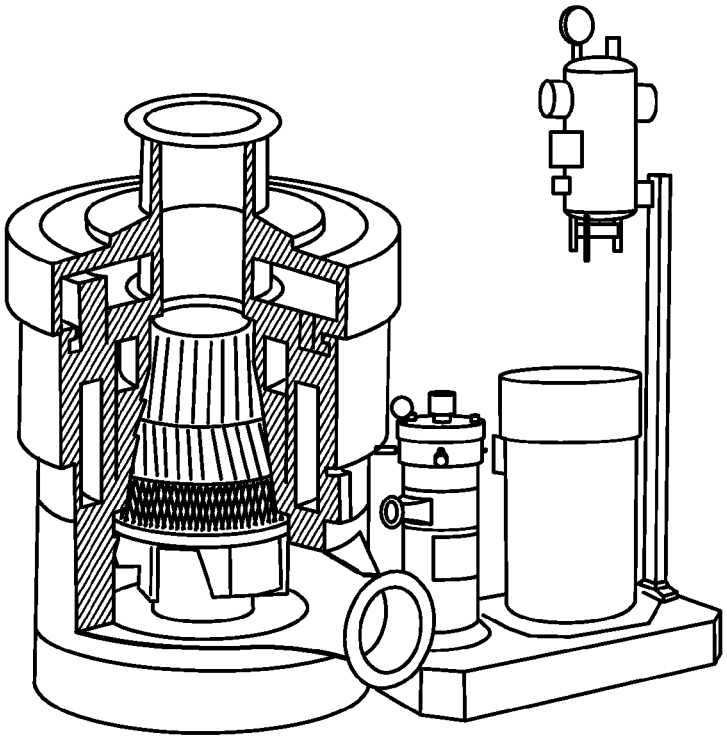
FIG. 3 is a cutaway view of the refiner showing the rotor and stator.

FIGS. 1-3 show one embodiment of the apparatus, an IKA MK 2000 colloid mill. There are several sizes of the MK 2000—the MK 2000/4, 2000/5, 2000/10, 2000/20, 2000/30 and 2000/50. The MK 2000/4 and 2000/5 have been tested. The apparatus has a motor 10 which operates the rotor 12 of the colloid mill 14 which sits on a stand 16. The fibers to be fiberized enter at the upper inlet 18 and pass between the rotor 12 and the stator 20 and exit at outlet 22.

Both the rotor 12 and the stator 20 in this embodiment are conical. Both rotor 12 and stator 20 have 3 sections, an upper section 24, a central section 26 and a lower section 28. The rotor and stator may have parallel bars 32 in each section. The bars 32 are separated by grooves 33. The spacing between bars 32 decreases from the upper section 24 through the central section 26 to the lower section 28. The spacing between the bars 32 of the upper section 24 is greater than the spacing between the bars 32 of the central section 26 and the spacing between the bars 32 of the central section 26 is greater the spacing between the bars 32 of the lower section 28. The spacing of the bars in each of the sections is the same for the rotor and the stator.

The distance between the bars 32 of the rotor and stator in the upper section 24 is greater than the spacing between the bars 32 of the rotor and stator of the central section 26, and the spacing between the bars 32 of the rotor and stator of the central section 26 is greater than the spacing between the bars 32 of the rotor and stator of the lower section 28. There is a large gap between the bars 32 of the rotor and stator in the upper section 24 and a narrow gap between the bars 32 of the rotor and stator in the lower section 28.

Each of the rotor and stator sections is conical in shape, angling inwardly from the bottom to the top of the section.

The bars in each section are at an angle from the vertical. The bars of the upper and lower sections are angled toward the left in a downward direction and the bars of the central section are angled toward the right in a downward direction.

Figure 4:
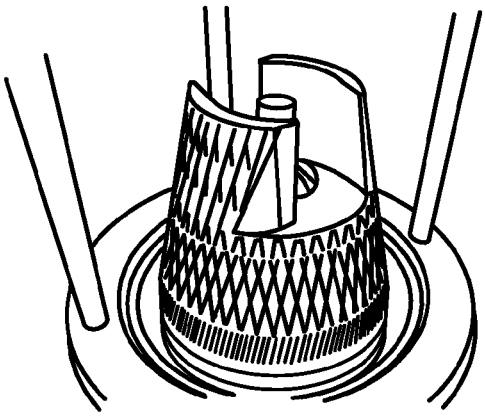
FIG. 4 is an isometric view of a different style of rotor.
Figure 5:
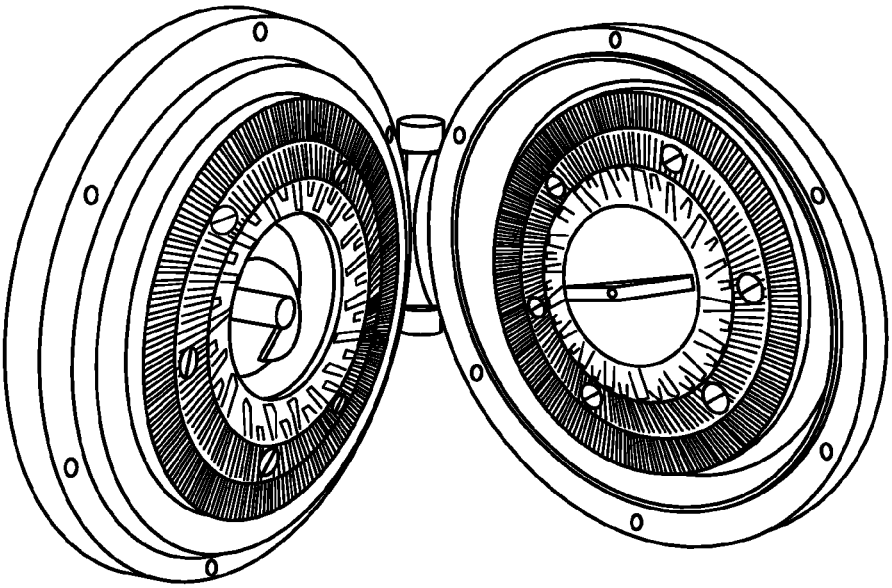
FIG. 5 is a side view of a disk refiner.
Figure 6:
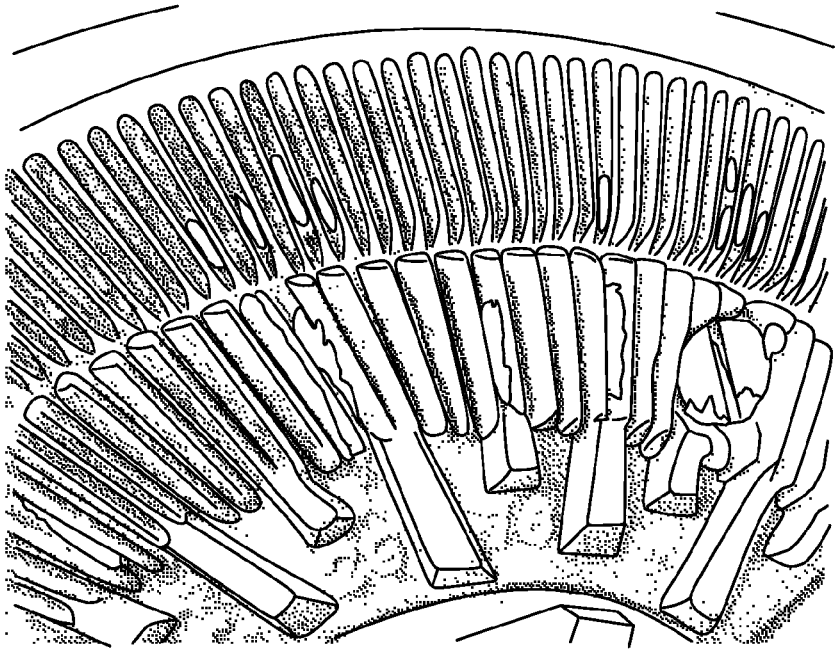
FIG. 6 is a front view of one of the refiner disks of the FIG. 5 refiner.

Another embodiment of the rotor is shown in FIG. 4. The rotor has cross cut grooves providing offset diamond shaped bars on the rotor. The rotor is still conical, still in three sections with the distance between the bars in the rotor and stator being greater in the upper section, smaller in the central section and smallest in the lower section. Two sets of grooves angled in opposite directions form the diamond shaped bars. The bottom section is the same in both embodiments with the bars being formed by single angled parallel grooves. The stator is the same as the stator in the first embodiment. This is the embodiment that was tested but it is believed that the first mentioned embodiment above will also provide the same product.

The upper section of the rotor has two quarter sections located opposite each other. The upper section of the rotor is open between the two sections.

It is believed that similar fibrillation can be done with a disc refiner with one rotating plate and one stationary plate having the same geometry of three sections of bars with the material entrance at the center and exit on the outer edge. The refiner would have three concentric sections with the bar spacing in the center section being wider than the bar spacing in the middle section and the bar spacing in the middle section being wider than the bar spacing in the outer section.

In the embodiment shown the bars in each of the sections of the rotating and stationary plates are angled with respect to the radius of the plates. The bars in the center and outer sections are angled in one direction and the bars in the middle section are angled in the opposite direction. Other embodiments could use different bar configurations.

The purpose is to provide in one step a lyocell and pulp blend that has a size that is the same as or similar to a lyocell and pulp blend that would be provided by a two step process.

A hydropulped material can be shipped at a consistency of 0.5 to 100%. A material that has been processed in a colloid mill can be shipped at a consistency of 0.5-10%.

Mixing

The fibrillated cellulose, wood pulp fibers or wood pulp and lyocell fibers, can be mixed with natural or synthetic rubber to form a composite material. They are first mixed by dispensing the aqueous cellulose slurry with a rubber latex and coagulating. This is commonly done with formic acid. The coagulated cellulose/rubber blend can then be compounded. It is also possible to dissolve solid rubber in an organic solvent and mix the fibrillated fibers with the rubber.

The following is a standard method of mixing natural or synthetic rubber and fillers A mixing mill consists essentially of two horizontal side by side rolls which are rotating at different speeds in opposite directions and can be heated or cooled. The gap between the rolls is adjustable and this gap is called the "nip" in rubber terminology. Raw rubber is placed between the rolls which usually have a diameter of 10-20 inch and are water cooled to maintain their temperature at about 140 F.

The two rolls which are made of special steel are mounted on a support made of cast iron or molded steel. In general, the bearings of the rear roll are stationary and those of the front roll movable, so that the clearance between the rolls can be varied. The rolls are driven by an electric motor and gear boxes. The front roll is rotated at a speed of about 15-25 r.p.m. The speed of the rear roll is higher, the ratio being 1:1.2 to 1:1.5.

The rubber is first added to the nip so that it forms a band on the front roll with a rolling 'bank' of rubber in the nip or gap form by the two rolls. In this nip, the rolls revolve the rubber 'bank' which consists of rubber compound brought back by the rotation of the front roll, and which will be carried along again by the roll. The size of the bank can be controlled by controlling the nip opening. It is obvious that the less the clearance between the two rolls, thinner will be the band of rubber on the front roll and thus the bulkier will be the bank of rubber waiting to be seized again by the rolls. The size of the bank is also controlled by the operator who cuts off put back, and transfers pieces of rubber from the band to the bank in order to obtain a very uniform compound.

Passing the raw rubber repeatedly between the two rolls of the mill will change its physical properties. The hard and compact raw rubber gradually becomes soft. It loses its elasticity and becomes plastic. After a given time period, which varies with the condition of working from some 10 to 40 minutes or longer, the raw rubber pieces form a soft and plastic strip which rotates together with the front roll. The raw rubber is then considered to be plasticized and is suitable for taking up fillers and other ingredients."

The fillers are then added and the above cutting and mixing is continued until it is a uniform mixture. At the end of the process, the rubber band is cut and peeled off roller.

The rubber is vulcanized at standard vulcanizing temperatures, pressures and times. In one embodiment the temperature is 287° C., the pressure is 100 inch pounds and the time 30 minutes. The typical vulcanizing additives at the usual amounts can be used. In one embodiment these additives can be stearic acid, zinc oxide, sulfur and a rubber accelerator, N-oxydiethlene-2-benzothiazole-sulfenamide (OBTS). In one embodiment these additives were added in the following amounts per 200 parts by weight of rubber and fiber: stearic acid—2.61 parts by weight; zinc oxide—5.20 parts by weight; sulfur—3.54 parts by weight and OBTS—2.18 parts by weight.

In the following examples, natural rubber alone or with an additive as described below is vulcanized and stretched to determine stress at the various strain levels and the stress at break.

Example 1 is a natural rubber control. The natural rubber was vulcanized at 287° C. for 8 minutes.

Example 2 is natural rubber mixed with carbon black.

Example 3 is natural rubber mixed with silica.

Example 4 is natural rubber mixed with a 50/50 mixture of 6 mm long lyocell and low DP fibers which have been fibrillated in a two step process in which the first step was hydropulping and the second step was done in an IKA MK 2000/5.

Example 5 is natural rubber mixed with a 50/50 mixture of 6 mm long lyocell and low DP fibers which have been fibrillated in a one step process using an IKA MK 2000/5.

Example 6 is natural rubber mixed with a 50/50 mixture of 4 mm long lyocell and low DP fibers which have been fibrillated in a two step process of in which the first step was hydropulping and the second step was done in an IKA MK 2000/5.

Example 7 is natural rubber mixed with a 50/50 mixture of 4 mm long lyocell and low DP fibers which have been fibrillated in a one step process using an IKA MK 2000/5.

TABLE 1

| Strain % | | Stress | | | | | | |
|---|---|---|---|---|---|---|---|---|
| elongation | Units | Ex. 1 | Ex. 2 | Ex. 3 | Ex. 4 | Ex. 5 | Ex. 6 | Ex. 7 |
| 50 | Psi | 83.8 | 241 | 454 | 213 | 220 | | |
| | MPa | 0.58 | 1.66 | 3.13 | 1.47 | 1.52 | | |

TABLE 1-continued

| Strain % elongation | Units | Stress Ex. 1 | Ex. 2 | Ex. 3 | Ex. 4 | Ex. 5 | Ex. 6 | Ex. 7 |
|---|---|---|---|---|---|---|---|---|
| 100 | Psi | 121 | 377 | 859 | 362 | 367 | 485 | 450 |
| | MPa | 0.83 | 2.6 | 5.92 | 2.5 | 2.53 | 3.33 | 3.1 |
| 200 | Psi | 188 | 798 | 1888 | 625 | 635 | 737 | 669 |
| | MPa | 1.3 | 5.5 | 13.02 | 4.31 | 4.38 | 5.02 | 4.61 |
| 300 | Psi | 271 | 1373 | 2600 | 911 | 933 | 1030 | 933 |
| | MPa | 1.87 | 9.47 | 17.93 | 6.28 | 6.43 | 7.1 | 6.43 |
| 400 | Psi | 377 | | | | | 1578 | 1450 |
| | MPa | 2.6 | | | | | 10.88 | 10 |
| 500 | Psi | 707 | | | | | 2648 | 2494 |
| | MPa | 4.87 | | | | | 18.26 | 17.2 |
| To break | Psi | 2983 | 3679 | 3086 | 3028 | 3011 | 3633 | 4015 |
| | MPa | 20.57 | 25.37 | 21.28 | 20.88 | 20.76 | 25.05 | 27.68 |

Figure 7:
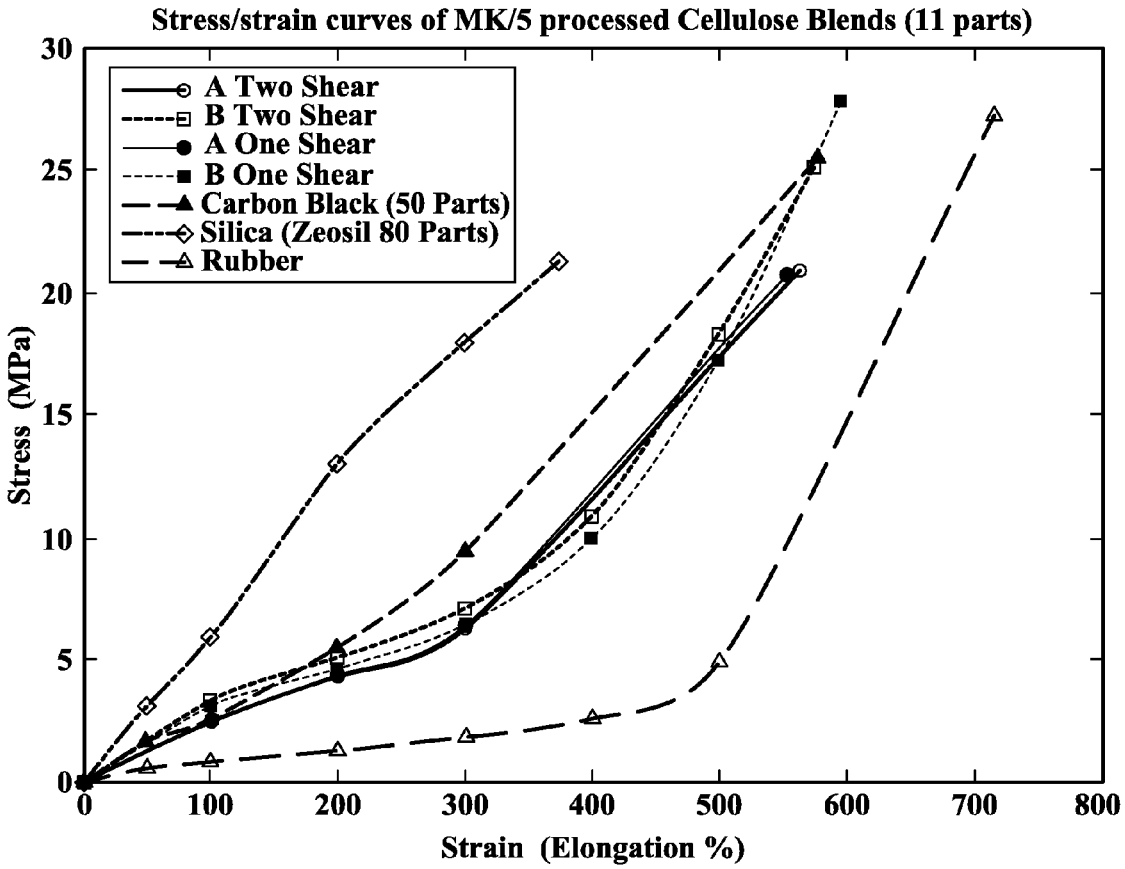
FIG. 7 is a stress-strain graph for different materials in natural rubber.

The results are shown in FIG. 7.

What is claimed is:

1. A process for making a fibrillated blend of lyocell and cellulose pulp fibers comprising providing a blend of lyocell and cellulose pulp fibers wherein the lyocell is from 25% to 75% of the total weight of the blend of lyocell and cellulose pulp fibers, refining the blend in a high shear field device to provide a blend of fibrillated lyocell and pulp fibers having a diameter of 10 to 500 nanometers and a fiber length of 50 to 500 μm.

2. The process of claim 1 in which the high shear field device is a homogenizer or colloid mill.

3. The process of claim 1 in which the weight of the lyocell is from 40 to 60% of the weight of the blend.

4. The process of claim 3 in which the high shear field device is a homogenizer or colloid mill.

5. The process of claim 1 in which the weight of the lyocell is 50% of the weight of the blend.

6. The process of claim 5 in which the high shear field device is a homogenizer or colloid mill.

7. The process of claim 1 in which the blend passes through three sections of increased restriction in the high shear field device.

8. The process of claim 7 in which the high shear field device is a homogenizer or colloid mill.

9. The process of claim 1 in which the blend passes through decreased sizes of rotors and stator bars in the high shear field device.

10. The process of claim 9 in which the high shear field device is a homogenizer or colloid mill.

* * * * *